US009505220B1

(12) United States Patent
Simon et al.

(10) Patent No.: US 9,505,220 B1
(45) Date of Patent: Nov. 29, 2016

(54) CATCHER FOR COLLECTING INK FROM NON-PRINTED DROPS

(71) Applicant: Eastman Kodak Company, Rochester, NY (US)

(72) Inventors: Robert J. Simon, Bellbrook, OH (US); Chang-Fang Hsu, Beavercreek, OH (US); Seth C. Clark, Centerville, OH (US); Charles D. Rike, Lebanon, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/736,371

(22) Filed: Jun. 11, 2015

(51) Int. Cl.
*B41J 2/17* (2006.01)

(52) U.S. Cl.
CPC ..... *B41J 2/1721* (2013.01)

(58) Field of Classification Search
CPC ..... B41J 2/1721; B41J 2002/1728; B41J 2002/1735; B41J 2002/1742
See application file for complete search history.

(56) References Cited

U.S. PATENT DOCUMENTS 3,777,307 A 12/1973 Duffield
3,936,135 A 2/1976 Duffield
4,035,811 A 7/1977 Paranjpe
4,268,836 A 5/1981 Huliba et al.
6,187,212 B1 2/2001 Simon et al.
6,457,807 B1 10/2002 Hawkins et al.
6,491,362 B1 12/2002 Jeanmaire
6,505,921 B2 1/2003 Chawlek et al.
6,554,410 B2 4/2003 Jeanmaire et al.
6,575,566 B1 6/2003 Jeanmaire
6,588,888 B2 7/2003 Jeanmaire
6,793,328 B2 9/2004 Jeanmaire
6,827,429 B2 12/2004 Jeanmaire et al.
6,851,796 B2 2/2005 Jeanmaire et al.
2009/0295880 A1* 12/2009 Hanchak ..... B41J 2/09 347/77
2010/0110149 A1* 5/2010 Hanchak ..... B41J 2/09 347/77
2010/0295912 A1* 11/2010 Xie ..... B41J 2/185 347/90

FOREIGN PATENT DOCUMENTS

EP 805 039 12/2001

* cited by examiner

*Primary Examiner* — Bradley Thies
(74) *Attorney, Agent, or Firm* — Nelson A. Blish; William R. Zimmerli

(57) ABSTRACT

A catcher (42) for collecting ink from non-printed drops and returning the ink to a fluid reservoir (40), the catcher includes a flow channel (47) having a plurality of branches (110); a structure to split a portion of each branch into two parallel sections to permit fluid to pass through either section; and wherein the flow of the two parallel sections (122) merge into a single flow downstream of the structure.

10 Claims, 12 Drawing Sheets

CATCHER FOR COLLECTING INK FROM NON-PRINTED DROPS

FIELD OF THE INVENTION

The invention pertains in general to an inkjet printer and in particular to a catcher for collecting ink from non-printed drops and returning the ink to a fluid reservoir.

BACKGROUND OF THE INVENTION

In continuous inkjet printheads, ink is continuously jetted from each nozzle, with each inkjet breaking off to create streams of drops. A portion of the created drops are selected to strike the print media while the remaining drops are made to strike a catcher, which returns the ink from the non-print drops to the fluid reservoir. One common type of catcher, known as a Coanda catcher, has a drop impact face against which the non-impact drops strike. The ink from the impacting drops flows along the face of the catcher and around a curved surface to enter the fluid removal channel of the catcher, from which the fluid is returned to the ink reservoir.

U.S. Pat. No. 3,936,135 (Duffield) discloses a Coanda catcher, in which the non-impact drops impact a face of the catcher, and the ink flows around the Coanda radius to enter the fluid removal channel. It is taught that by maintaining the vacuum, used for extracting the ink from the fluid removal channel below a certain critical level, a stable meniscus can be established at the entrance of the fluid removal channel thereby preventing air from being drawn into the fluid removal channel. As indicated in U.S. Pat. No. 4,035,811 (Paranjpe), the catcher arrangement of U.S. Pat. No. 3,936,135 is able to handle only moderate ink flow rates. EP 0 805 039 (Loyd) discloses a Coanda catcher having a fluid return channel designed to limit the amount of air ingested into the fluid return channel while providing a wider operating range of vacuum for evacuation of the ink than the U.S. Pat. No. 3,936,135 catcher.

For printheads having arrays of nozzles, the fluid removal channel must extend the length of the nozzle array. It is necessary to effectively remove ink from the fluid removal channel down the entire length of the fluid removal channel. U.S. Pat. No. 3,777,307 (Duffield) provided ink removal ports at each end of the catcher to avoid an excessive vacuum gradient within the catcher. U.S. Pat. No. 4,268,836 (Huliba et al.) describes a catcher in which the fluid removal channel of the catcher is divided down the length of the nozzle array into segments by flow partitions. Each segment has a separate ink removal port through which ink is removed from that segment to further improve the uniformity of the vacuum within the catcher. U.S. Pat. No. 6,187,212 (Simon et al.) segments the fluid removal channel into a number of flow channel branches, in which the lengths and widths of the different branches are selected to ensure approximately uniform flow impedances for each of the parallel branches and therefore provide more uniform fluid extraction across the width of the entrance of the fluid removal channel.

While these catcher designs are effective in removing ink across the width of the entrance of the fluid removal channel under normal conditions, ink extraction problems can occur when there are large differences in printed ink coverage across the width of a printhead. There remains a need to improve the extraction of ink from the catcher across the width of the printhead.

SUMMARY OF THE INVENTION

Briefly, according to one aspect of the present invention a catcher for collecting ink from non-printed drops and returning the ink to a fluid reservoir, the catcher includes a flow channel having a plurality of branches; a structure to split a portion of each branch into two parallel sections to permit fluid to pass through either section; and wherein the flow of the two parallel sections merge into a single flow downstream of the structure.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
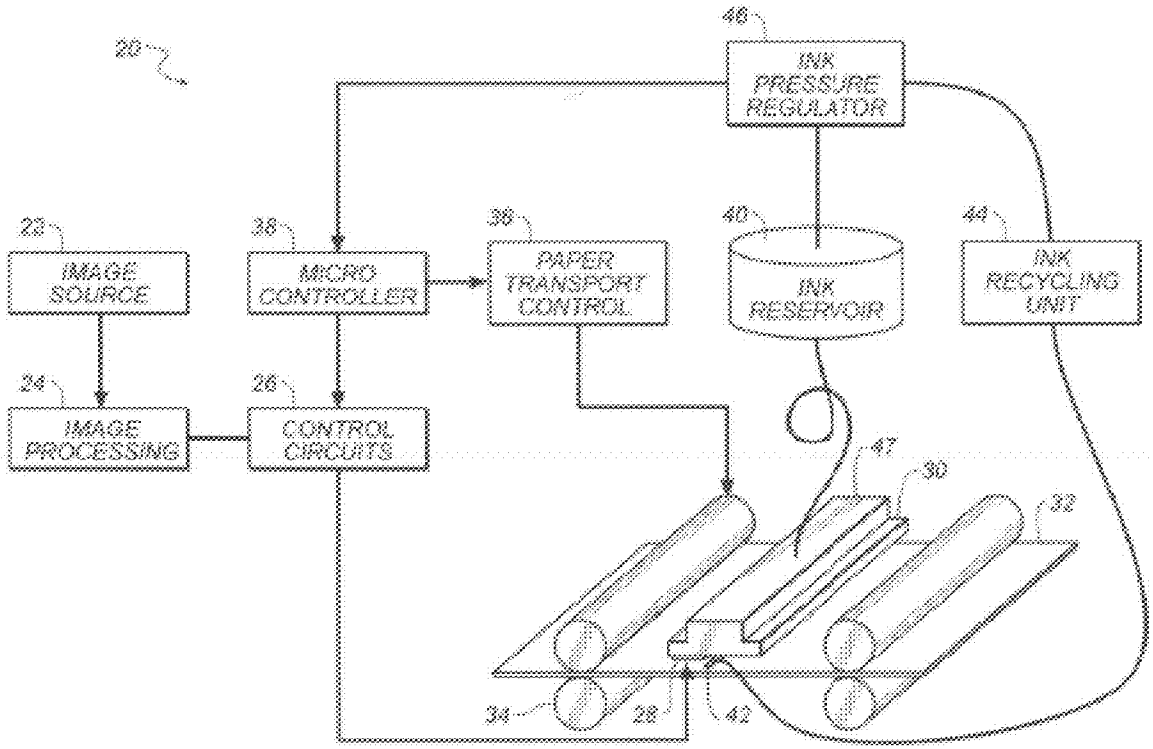
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous inkjet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. When the image data does not call for printing a drop on the recording medium, continuous inkjet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1), which is described in more detail below with reference to FIGS. 2 and 3.

Figure 2:
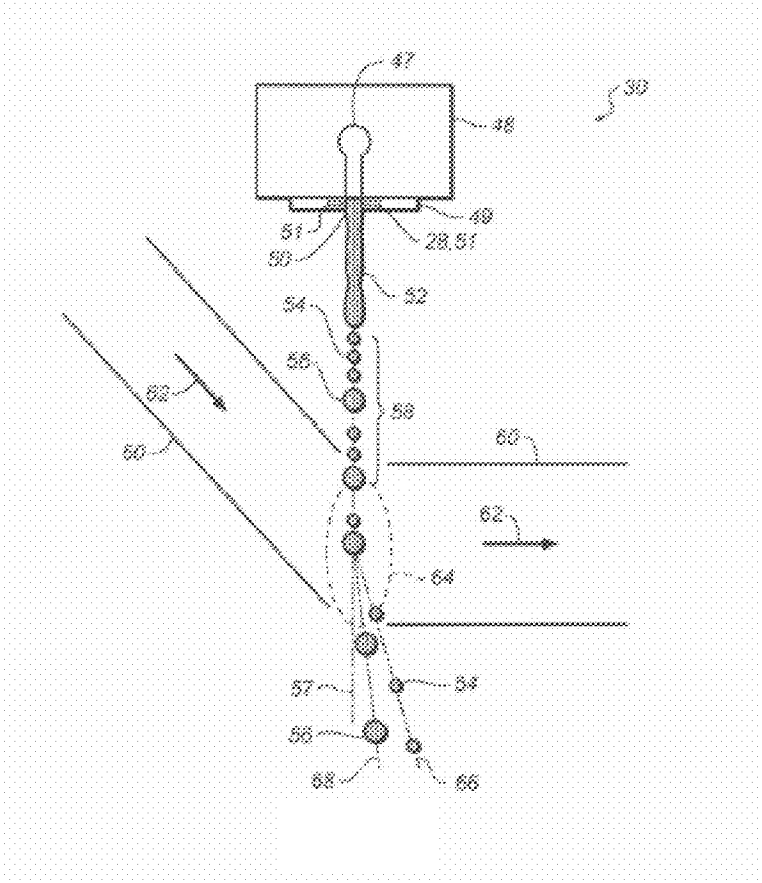
FIG. 2 is a schematic side cross-section view of an example embodiment of a continuous printhead made in accordance with the present invention.
Figure 3:
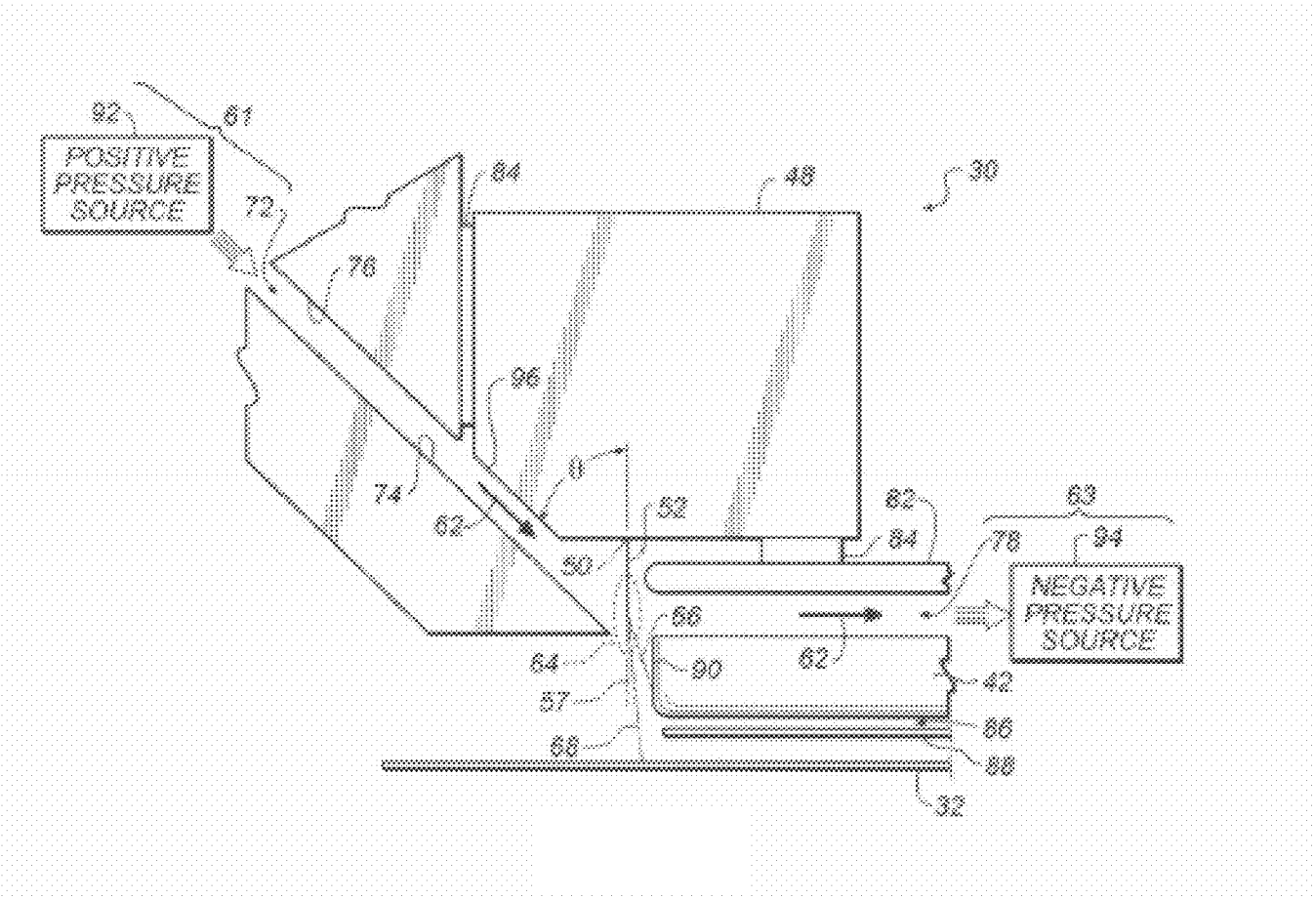
FIG. 3 PRIOR ART
FIG. 3 is a schematic side cross-section view of a portion of a prior art continuous printhead.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Figure 4:
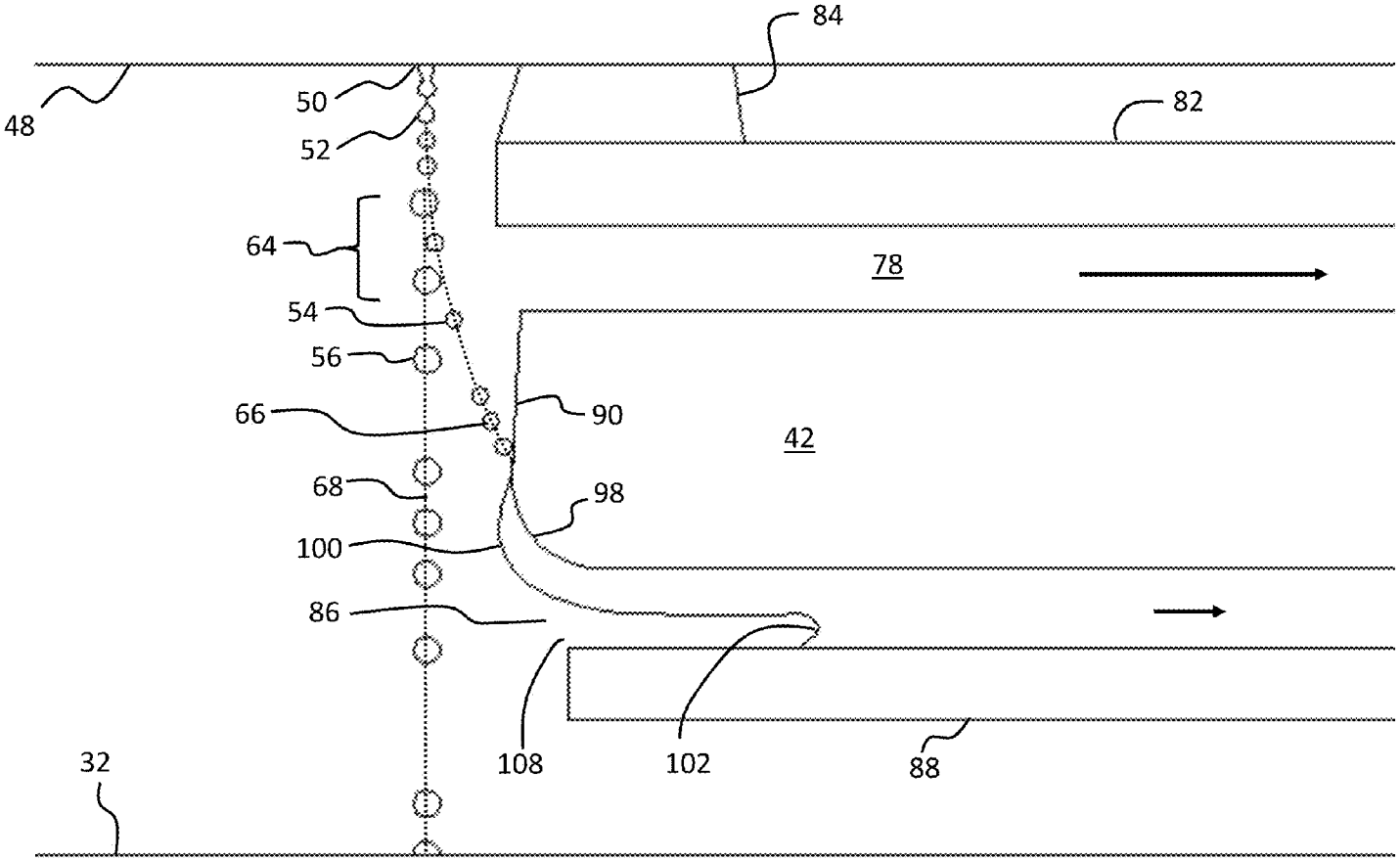
FIG. 4 PRIOR ART
FIG. 4 is a schematic side cross-section view of a portion of a prior art continuous printhead.

Liquid, for example, ink, is emitted under pressure through each nozzle 50 of the array to form filaments of liquid 52. In FIGS. 2-4, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to break off from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.).

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64, it alters the drop trajectories. As the drop trajectories pass out of the deflection zone 64, they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes positive gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides a gas seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a negative gas flow duct 78 located between catcher 42 and an upper wall 82 that exhausts gas flow from deflection zone 64. The negative gas flow duct 78 is connected to a negative pressure source 94 that is used to help remove gas flowing through second duct 78. An optional seal(s) 84 provides a gas seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by positive gas flow duct 72 is directed into the drop deflection zone 64, where it causes large drops 56 to follow large drop trajectory 68 and small drops 54 to follow small drop trajectory 66. As shown in FIG. 3 and more clearly in FIG. 4, small drop trajectory 66 is intercepted by a front face 90 of catcher 42. Small drops 54 contact face 90 and flow down face 90 as an ink layer 100 around the catcher radius 98 and into a catcher flow channel 86, commonly referred to as a catcher return duct 86, located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a catcher flow channel located or formed in catcher 42. Collected liquid is either recycled for reuse or discarded. Small drops 54 bypass catcher 42 and travel on to recording medium 32.

Figure 5:
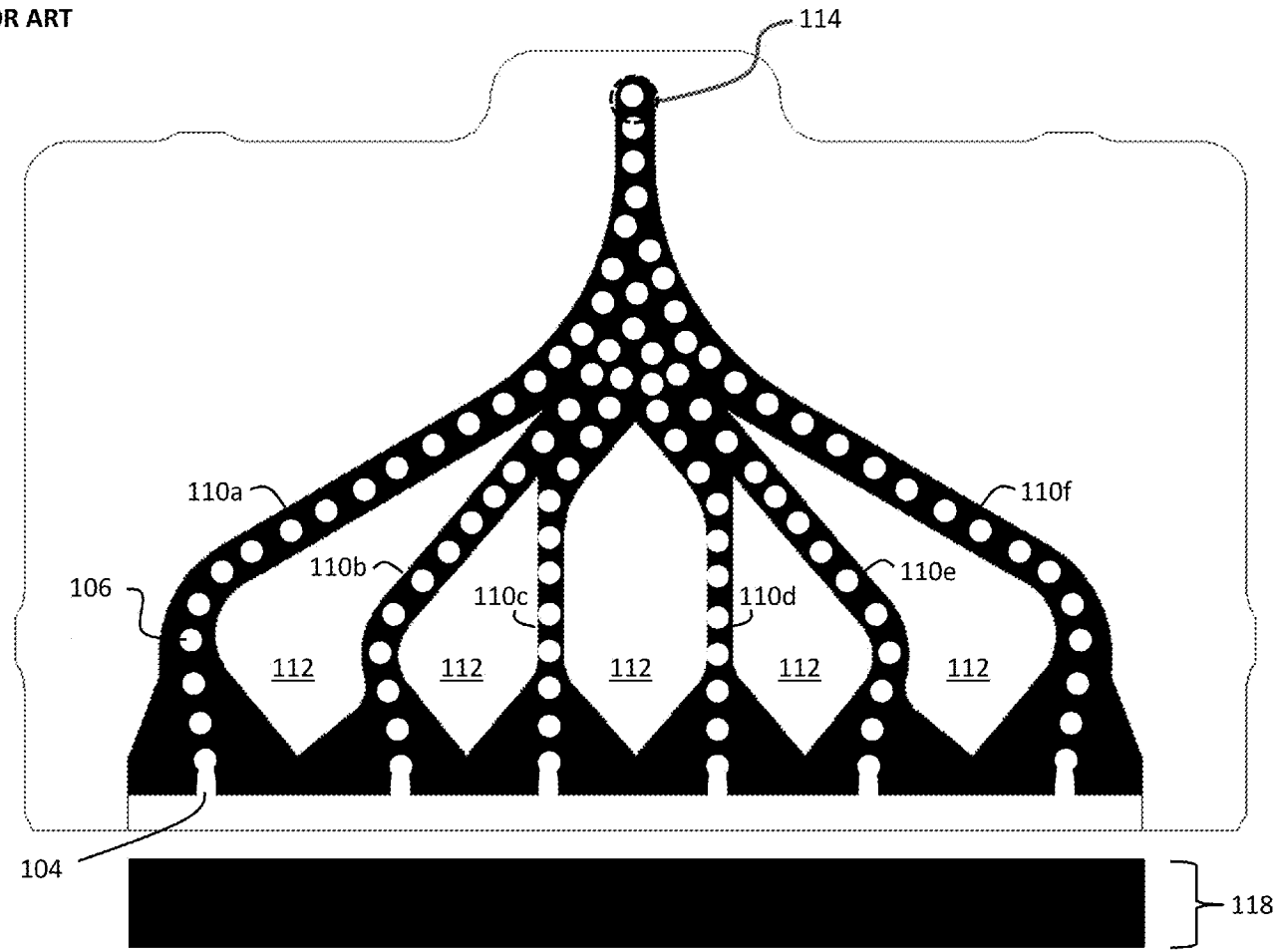
FIG. 5 PRIOR ART
FIG. 5 is a plan view of fluid flow in the catcher flow channels of a prior art catcher with a uniform ink return profile.

The ink layer 100 entering the catcher flow channel tends to bridge the catcher flow channel 86 to form a meniscus 102 across the flow channel. Vacuum applied to the outlet of the catcher flow channel draws the ink through the flow channel to return it to the ink reservoir 40. As the suction acts on the ink, it can draw the meniscus deeper into the catcher flow channel 86. As shown in FIG. 5, the meniscus however does not tend to get drawn in uniformly across the width of the flow channel, but rather fingers of air 104 can form which extend into the ink in the flow channel 86. The air bubbles 106, which break off from these fingers of air, flow with the ink through the flow channel of the catcher. The fingers of air and the stream of bubbles that break off from the fingers of air tend to align with the lowest flow impedance path between the catcher outlet port 114 and the entrance 108 to the catcher flow channel 86.

As discussed in commonly assigned U.S. Pat. No. 6,187,212, and illustrated in more detail in FIG. 6, the breaking up of the catcher flow channel 86 into multiple branches **110*a*-110*f* by means of islands 112 helps to make the flow impedance between the catcher outlet port 114 and the entrance to the catcher flow channel more uniform across the width of the catcher flow channel 86. The width of the various branches 110*a*-110*f* is varied along with the length of the branches to produce the more uniform flow impedance from branch to branch. The islands 112 that separate the catcher flow channel into the branches do not extend all the way to the entrance 108 of the catcher flow channel but rather are recessed into the catcher flow channel so that a common flow region 111 is present to the entrance side of the leading edge 128 of the islands 112. The branches each have a converging zone in which the cross-sectional length of each branch is reduced from its initial length at the leading edge of the islands to a nearly constant cross-sectional length that is used for the remainder of the branch. The islands also do not extend all the way to the catcher outlet port 114. Instead a common flow channel 134 is present downstream of the trailing edge 136 of the islands 112**.

Figure 6:
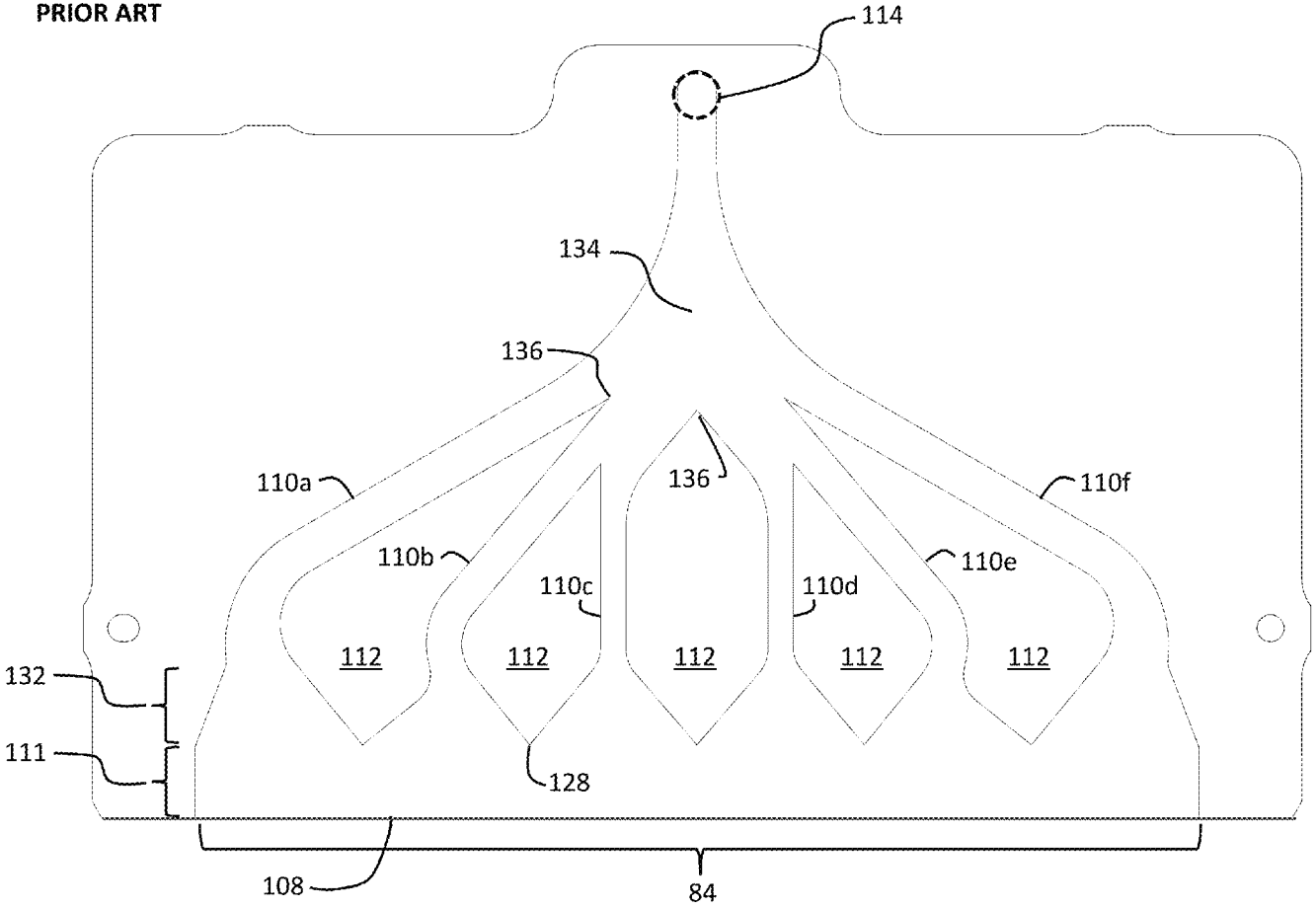
FIG. 6 PRIOR ART
FIG. 6 is a plan view of the catcher flow channels of a prior art catcher.
Figure 7:
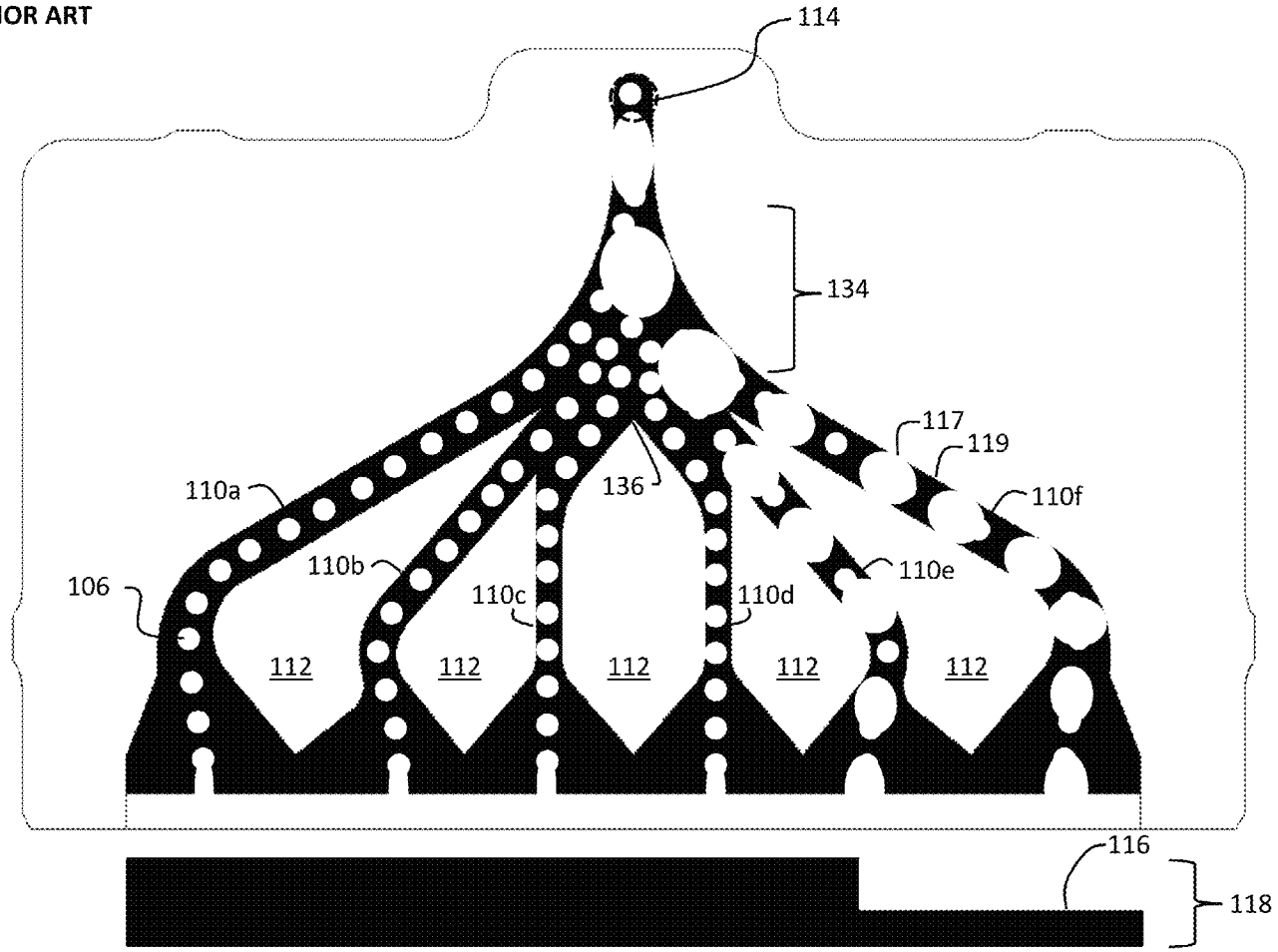
FIG. 7 PRIOR ART
FIG. 7 is a plan view of fluid flow in the catcher flow channels of a prior art catcher with a non-uniform ink return profile.
Figure 8:
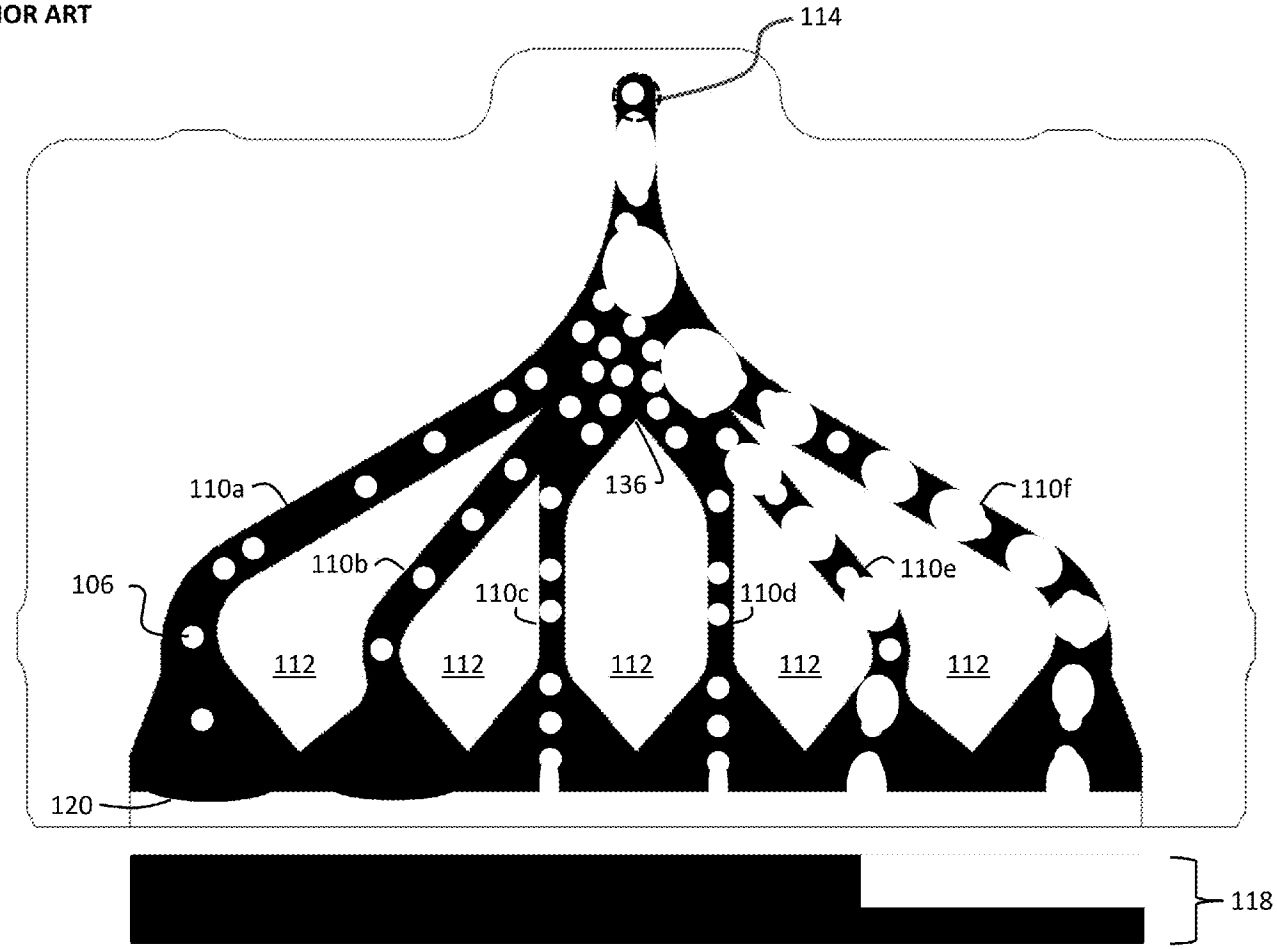
FIG. 8 PRIOR ART
FIG. 8 is a plan view of fluid flow in the catcher flow channels of a prior art catcher with a non-uniform ink return profile.

While the flow channel design of FIG. 6 is effective under most conditions, it has been found that ink can drip out of portions of the catcher flow channel under some print image conditions. This image dependent dripping tends to occur when printing large blocks of full coverage, every pixel is printed, for some portions of the printhead and little or no print in other large portions of the printhead when printing at high print media speeds. Under such printing conditions, the flow of ink into the catcher flow channel, ink return flow rate 116, is low in the portions of the printhead with the high print coverage while the flow of ink into the catcher flow channel remains high in the other portions of the printhead. Such an ink coverage profile 118 is shown in FIG. 7. In the branches of the catcher flow channel with the reduced ink flow rate, branches **110*e* and 110*f*, greater amounts of air are drawn into these branches. This can produce slug flow in those branches with alternating slugs of air 117 and slugs of ink 119, which span the width of the branch 110*a*-110*f*, passing through the branches. As these large slugs of air flow into the common flow channel 134, downstream of the trailing edge 136 of island where the branches converge upstream of the catcher outlet port 114, they lower the vacuum level in the common flow channel. As a result of the reduced vacuum level, the rate at which ink can be extracted through the other branches 110*a*-110*d* is reduced, which can produce the observed dripping for the catcher. This is illustrated in FIG. 8 by the reduced amount of air bubbles 106 in the branches 110***a*-110*d* and some bulging 120 out of the ink in the entrance region by branches 110*a* and 110*b*.

Figure 9:
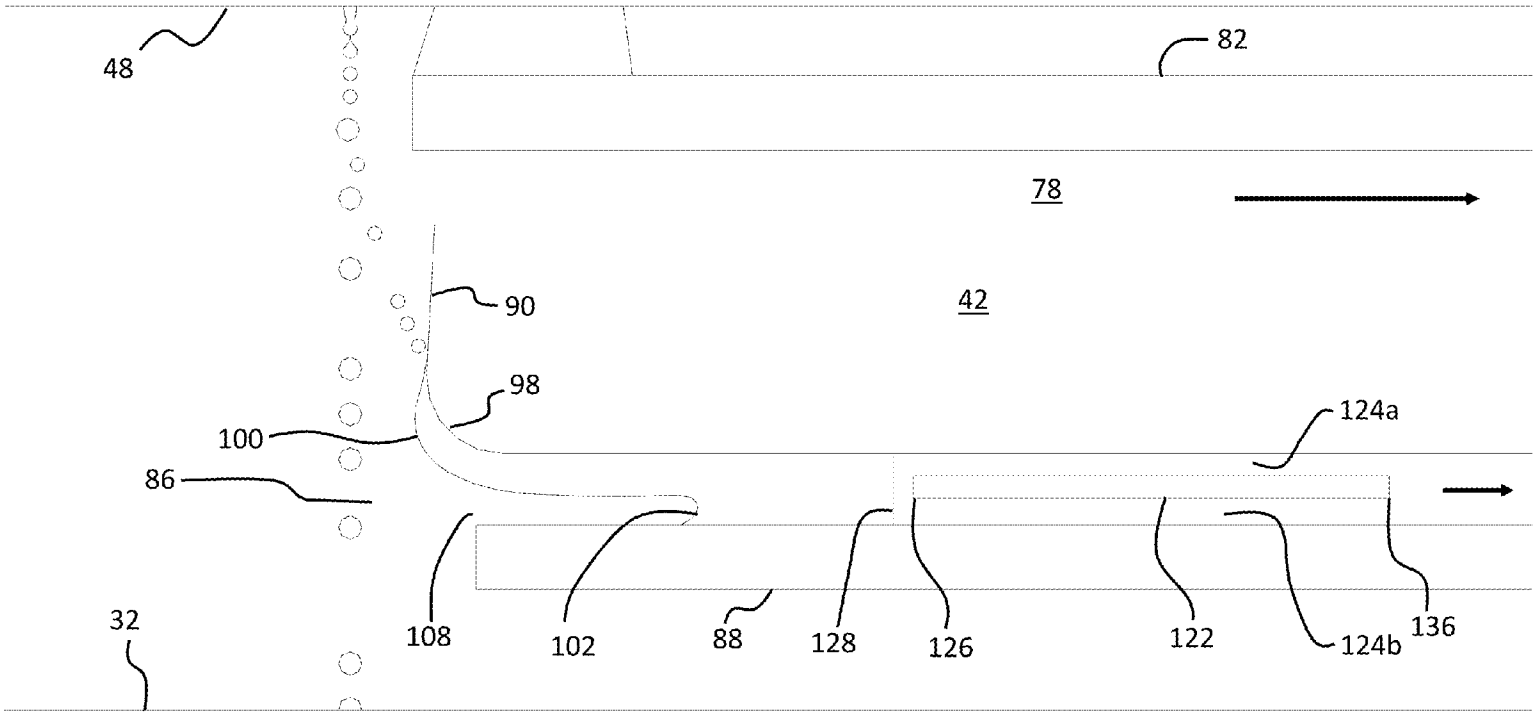
FIG. 9 is a schematic side cross-section view of a portion of a continuous printhead made in accordance with the present invention.
Figure 10:
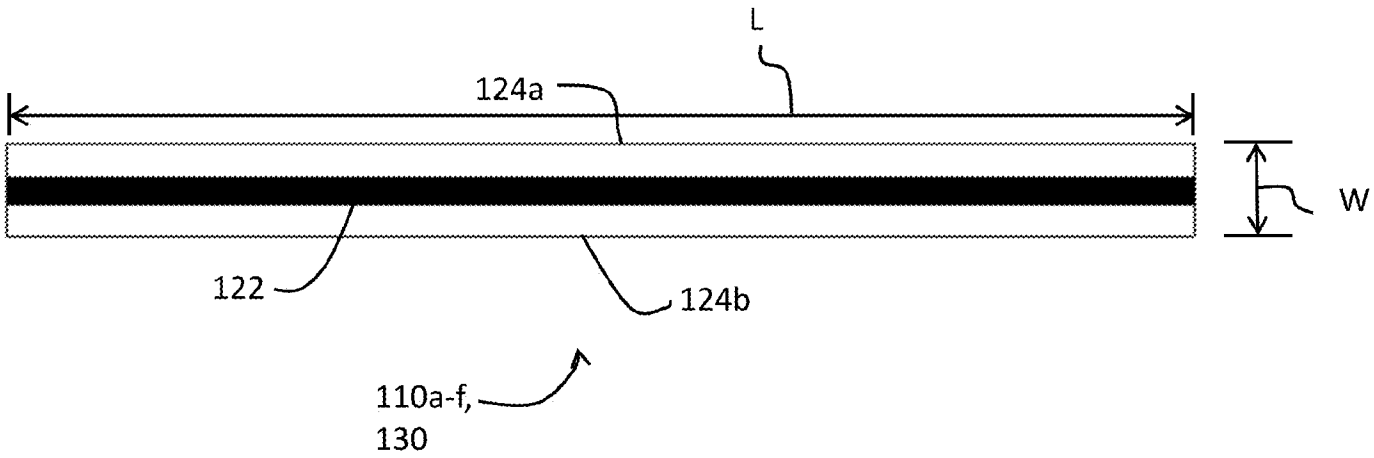
FIG. 10 is a front view of a branch of the catcher flow channel incorporating a structure made in accordance with the present invention.

The present invention reduces or eliminates this problem of image pattern-dependent dripping by introducing a structure 122 into each of the branches to split a portion of each branch into two parallel sections 124 through which fluid is permitted to pass. A side cross-section view of a branch 110 with the structure 122 is provided in FIG. 9. One section 124*a* is present between the structure 122 and the catcher 42, and the second section 124*b* is present between the structure and the plate 88. The sections are parallel to each other in circuitry manner rather than necessarily parallel to each other in a geometric sense; that is the section are parallel to each other in that both sections connect between an upstream portion of a channel to downstream portion of the same channel. The leading edge 126 of the structure 122 is positioned in the branch approximately at the depth of the leading edge 128 of the islands 112 that segment the catcher flow channel 86 into branches 110*a*-110*f* or downstream of the leading edge of the islands. The two parallel sections are free of any obstruction that would impede fluid flow between the structure and the walls of the branch. FIG. 10 is a front or entrance cross-section view of a branch 110 showing the how the structure roughly bisects the branch. The front cross-section 130 of the branch has a length L and a width W, the length extending along a direction approximately parallel to the array of nozzles. The width direction being perpendicular to the length and corresponding to the height direction of the branch, and is approximately parallel to the undeflected ink drop trajectories. The structure 122 divides the width of the branch 110*a* into two sections 124*a* and 124*b*, the cross-section of each of the two sections having a length approximately equal to the length of the branch. The structure seems to reduce the problem of image pattern-dependent dripping by reducing the amount of air that can be ingested into the branches that have reduced ink flow rates. By reducing the flow rate of air into branches with lower ink flow rates, the structure inhibits the onset of slug flow in those branches and thereby inhibits the vacuum fluctuations that slug flow can create. As a result, the vacuum level near the catcher outlet port 114 is less sensitive to fluctuations in ink flow rates in the various channels than prior art catchers and the catcher is less likely to drip.

The structure 122 is preferably placed near the midpoint of the height of each branch 110*a*-110*f* so that the flow regions on each side of the structure have cross-sectional areas within 30 percent of each other. Preferably the structure has a thickness that is less than ⅓ the width of the branch and greater than 1/10 the width of the channel, as thicknesses of greater than one third the branch width produce excessive flow impedance through the branch and thicknesses of less than 1/10 the width of the channel seems to be less effective in reducing air flow rates through the branches under the low ink flow rate conditions.

In a preferred embodiment, the structure is a woven stainless steel screen with plain weave having 42 wires per inch. Such woven screens include pores that allow fluid communication between the parallel sections and that can retain liquid when air is passing through the sections on one or both sides of the screen. While other screen mesh sizes can be used, it has been found that tightly woven screens do not work as well as the more open screens. It is anticipated that other porous materials can be used beside the woven stainless steel screen, though preferably the material is wettable by the ink, such that the contact angle of the ink is less than 90 degrees, as wettable porous materials more readily retain liquid in the pores of the material than do non-wettable materials.

The structure is preferably positioned such that the leading edge 126 (edge closest to the entrance of the catcher flow channel) of the structure 122 is located at or downstream of the leading edge 128 of the islands that separate the catcher flow channel into the individual branches 110*a*-110*f* Preferably the leading edge of the structure is located in the converging portion 132 of the branch (FIG. 6). The structure preferably extends a distance L of between 2 mm and 10 mm along the channel flow direction, and more preferably a distance L of between 4 mm and 6 mm along the channel flow direction. With such a placement of the structure, the common flow region, upstream of the leading edge of the islands, is located upstream of at least a portion of the structure. This placement also positions the trailing edge of structure upstream of the common flow channel, where the located individual branches merge prior to the catcher outlet port 114.

Figure 11:
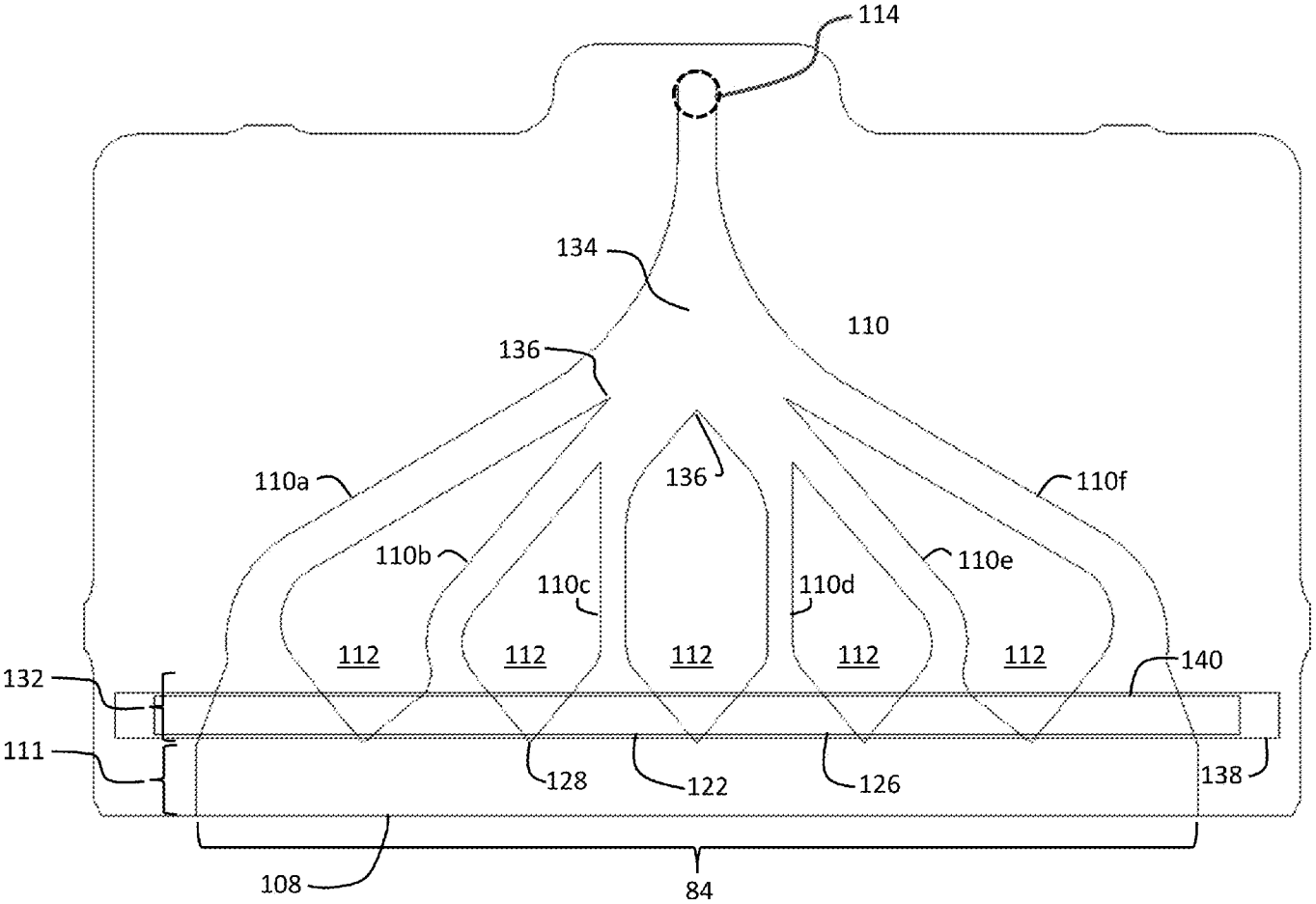
FIG. 11 is a plan view of the catcher flow channels incorporating a structure made in accordance with the present invention.
Figure 12:
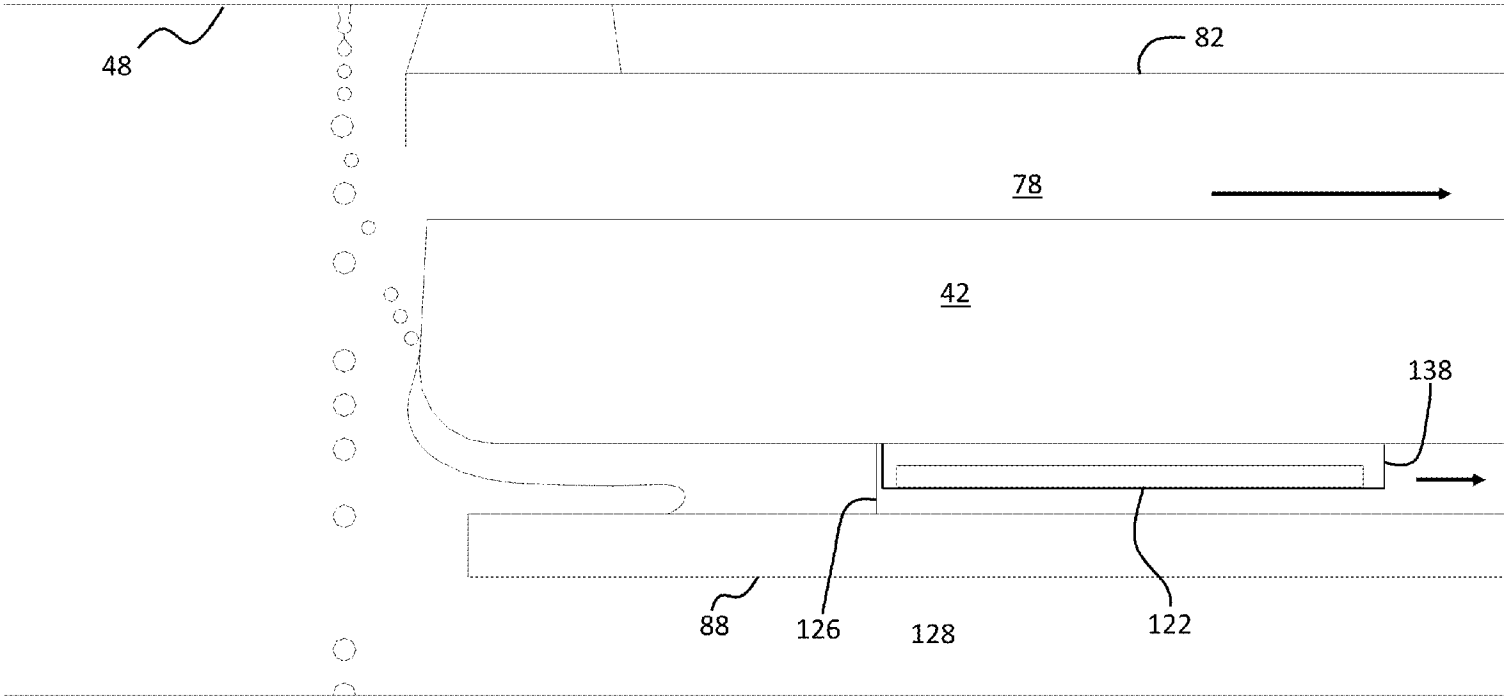
FIG. 12 is a schematic side cross-section view of a portion of a continuous printhead made in accordance with the present invention.

In a preferred embodiment, the catcher flow channels are fabricated by machining into the upper face of the plate 88. Rather than fabricate separate structures for each of the branches, a single structure 122 is fabricated which spans all the branches. This structure is placed in a recess 138 formed in the upper face of the plate, as shown in FIGS. 11 and 12. The recess spans all the branches and the islands that separate them. The depth of the recess determines the vertical placement of the structure in the branches. The structure can be secured in the recess in the region of the islands and off each end of the catcher flow channel by welding or with appropriate adhesives.

The invention has been described in detail with particular reference to certain preferred embodiments thereof, but it will be understood that variations and modifications can be effected within the spirit and scope of the invention.

PARTS LIST

20 continuous printer system
22 image source
24 image processing unit
26 mechanism control circuits
28 device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure

64 deflection zone
66 small drop trajectory
68 large drop trajectory
72 positive gas flow duct
74 lower wall
76 upper wall
78 negative gas flow duct
82 upper wall
84 seal
86 catcher flow channel
88 plate
90 front face
92 positive pressure source
94 negative pressure source
96 wall
98 catcher radius
100 ink layer
102 meniscus
104 finger of air
106 air bubbles
108 entrance
110*a*-110*f* branch
111 flow region
112 island
114 catcher outlet port
116 ink return flow rate
117 slug of air
118 ink return profile
119 slug of ink
120 ink bulge
122 structure
124*a* section
124*b* section
126 leading edge (structure)
128 leading edge (island)
130 cross-section
132 converging zone
134 common flow channel
136 trailing edge (island)
138 recess
L length
W width

The invention claimed is:

1. A catcher including a catcher face for intercepting non-printed drops, a flow channel for returning ink from the intercepted non-printed drops to a fluid reservoir, and a catcher radius around which the ink from the intercepted non-printed drops can flow from the catcher face into the flow channel, the flow channel comprising:

a plurality of branches separated from each other by one or more islands;

a structure to split a portion of each branch into two parallel sections to permit fluid to pass through either section; and wherein the flow of the two parallel sections merge into a single flow downstream of the structure.

2. The catcher of claim 1 wherein the structure is a porous member allowing fluid communication between the two parallel sections.

3. The catcher of claim 2 wherein the porous member comprises a woven mesh screen.

4. The catcher of claim 2 wherein the two sections each have cross-sectional areas within 30 percent of the cross-sectional area of the other of the two section.

5. The catcher of claim 1 wherein the islands each having a leading edge, the flow channel includes a single flow section upstream of the leading edge of the islands that divides the flow channel into the plurality of branches.

6. The catcher of claim 5 wherein the single flow section is upstream of at least a portion of the structure.

7. The catcher of claim 1 wherein the plurality of branches merge to form a common flow channel downstream of the structure.

8. The catcher of claim 1 wherein the two parallel sections are unobstructed.

9. The catcher of claim 1 wherein the structure is positioned in a converging portion of the plurality of branches.

10. A method for collecting ink using a catcher including a catcher face for intercepting non-printed ink drops, a flow channel for returning ink from the intercepted non-printed ink drops to a fluid reservoir, and a catcher radius around which the ink from the intercepted non-printed ink drops flows from the catcher face into the flow channel, the method comprising:

providing a plurality of branches separated from each other by one or more islands in the flow channel;

splitting a portion of each branch into two parallel sections to permit fluid to pass through either section; and merging the flow of the two parallel sections into a single flow downstream of the structure.

* * * * *